US006574306B2

(12) United States Patent
Kikuchi

(10) Patent No.: US 6,574,306 B2
(45) Date of Patent: Jun. 3, 2003

(54) CHANNEL-CUT MONOCHROMATOR

(75) Inventor: Tetsuo Kikuchi, Tachikawa (JP)

(73) Assignee: Rigaku Corporation, Tokyo (JP)

( * ) Notice: Subject to any disclaimer, the term of this patent is extended or adjusted under 35 U.S.C. 154(b) by 0 days.

(21) Appl. No.: 09/867,186

(22) Filed: May 29, 2001

(65) Prior Publication Data

US 2001/0053198 A1 Dec. 20, 2001

(30) Foreign Application Priority Data

May 31, 2000 (JP) ..... 2000-161302

(51) Int. Cl.[7] ..... G21K 1/06

(52) U.S. Cl. ..... 378/84; 378/70; 378/85; 378/145

(58) Field of Search ..... 378/84, 85, 145, 378/70

(56) References Cited

U.S. PATENT DOCUMENTS

| | | | | |
|---|---|---|---|---|
| 4,567,605 A | | 1/1986 | Bartels | |
| 5,509,043 A | * | 4/1996 | Van Der Sluis | 378/70 |
| 5,802,137 A | * | 9/1998 | Wilkins | 250/363.1 |
| 5,850,425 A | * | 12/1998 | Wilkins | 250/390.09 |

FOREIGN PATENT DOCUMENTS

| | | |
|---|---|---|
| JP | 59-108945 | 1/1986 |
| JP | 1-86100 | 3/1989 |
| JP | 4-264299 | 9/1992 |
| JP | 9-49811 | 2/1997 |
| JP | 9-49899 | 2/1997 |

* cited by examiner

*Primary Examiner*—Drew A. Dunn
*Assistant Examiner*—Courtney Thomas
(74) *Attorney, Agent, or Firm*—Frishauf, Holtz, Goodman & Chick, P.C.

(57) ABSTRACT

A channel-cut monochromator has at least two kinds of reflecting surface pairs processed on a common single crystal block. Each reflecting surface pair has a first and a second reflecting surfaces between which X-rays are reflected even-number times. The channel-cut monochromator can be rotated around an axis of rotation perpendicular to a reference plane so as to switch the reflecting surface pair which reflects X-rays. An X-ray beam incident on any reflecting surface pair or its extension line is tangent to a common imaginary circle whose center coincides with the axis of rotation. With this structure, the switchover of the reflecting surface pair is accomplished by only the rotation of the channel-cut monochromator around its axis of rotation, so that various X-ray beams reflected by various Miller indices can be taken out selectively. The channel-cut monochromator may have a direct path through which an X-ray beam passes in no contact with any reflecting surface. The channel-cut monochromator may be made of silicon or germanium single crystal and may have preferably five or more kinds of reflecting surfaces, for example, for {220}, {400}, {422}, {511} and {111} reflection. Further, at least one of reflecting surface pair may have one or two asymmetrical reflecting surfaces.

14 Claims, 14 Drawing Sheets

CHANNEL-CUT MONOCHROMATOR

BACKGROUND OF THE INVENTION

This invention relates to a channel-cut monochromator which can be used in a high-resolution X-ray diffractometer.

The high-resolution X-ray diffractometer has developed based on a certain technique called "double crystal method". With the double crystal method, a rocking curve (a graph indicating a relationship between an X-ray diffraction intensity and a diffraction angle for a certain diffraction peak) of a single crystal sample can be measured in such a manner that X-rays are diffracted by the first crystal to become a monochromatic beam and then it irradiates the sample (the second crystal). The first crystal may be usually a perfect-crystal of silicon (Si) or germanium (Ge). In the double crystal method, it is known that the angular resolution of the rocking curve becomes highest when the first crystal is the same as the sample crystal and also the diffraction plane of the first crystal is coincident with the object lattice plane of the sample crystal (i.e., the same d-value which is an interplaner spacing of lattice planes). Such an X-ray optics, in which the first crystal and the sample crystal have the same d-value, is called "parallel arrangement". With this ideal arrangement, the full width at half maximum intensity (FWHM) of a measured rocking curve becomes narrowest and the shape of the rocking curve is almost coincident with the theoretically-predicted shape.

Alternatively, even when the first crystal and the sample crystal are not perfectly the same, a high resolution is obtained using the first crystal having the d-value which is nearly equal to that of the object lattice plane of the sample crystal, this optics being called "quasi parallel arrangement". For example, the first crystal may be a germanium perfect-crystal with {400} reflection for obtaining the rocking curve of {400} reflection of GaAs single crystal or InP single crystal.

A large difference in d-value between the first crystal and the second crystal lowers resolution because the wavelength dispersion effect is added in a manner of convolution, so that the FWHM of a measured rocking curve becomes broader. It is desirable therefore, for measuring the highest-resolution rocking curve using the double crystal method, to select the first crystal having a d-value most closest to that of the sample crystal, the d-value of the sample crystal depending upon the kind of the crystal and the Miller indices of the object lattice plane of reflection. Accordingly, it is necessary to change the first crystal frequently in response to the kind of the sample crystal and its object Miller indices and further to conduct X-ray optical alignment whenever the first crystal is changed.

It is troublesome, however, to conduct the optical alignment again by altering the crystal arrangement based on the double crystal method and such alignment operation needs skill. Therefore, some improvements have developed for easy alignment: for example, the second crystal can be adjusted by rotation around the first crystal or the X-ray source can be adjusted by rotation around the first crystal as disclosed in, for example, Japanese patent publication No. JP 1-86100 A (1989). Such improvements, however, still need crystal exchange operation and alignment operation. Thus, such improvements still need troublesome operation and are not so efficient.

The first crystal is usually a flat crystal, but it is known that it may be a channel-cut monochromator which is manufactured by processing a groove on a monolithic single crystal block. X-rays may be diffracted plural times at the side walls of the groove to become a monochromatic parallel beam as disclosed in, for example, Japanese patent publication No. JP 9-49899 A (1997). If X-rays are diffracted even-number (e.g., two) times at the channel-cut monochromator, the output X-ray beam becomes a monochromatic parallel beam and travels in a direction parallel to the incident X-ray beam. If the output X-ray beam from the first crystal is parallel to the incident X-ray beam as mentioned above, an output X-ray beam from the first crystal after exchange of the first-crystal is to become parallel to the former output X-ray beam before the exchange. Accordingly, even when the first crystal is exchanged, it is not necessary, for alignment operation, to "rotate" the X-ray tube or the sample unit (i.e., goniometer unit) so that the system space can be minimized, noting that a translational movement is needed for alignment operation.

The channel-cut monochromator produces an output X-ray beam which is basically identical with one from a flat crystal monochromator with single reflection. However, when X-rays are diffracted "plural times" at the channel-cut monochromator, the reflection coefficient curve of the output X-ray beam has skirts with extremely reduced intensities, this being the effect of the plural times of diffraction. Also using the channel-cut monochromator, it is necessary, for obtaining the highest-resolution rocking curve, to exchange the monochromator to one having an optimum d-value in response to the kind of the sample crystal and its object Miller indices. And the exchange of the channel-cut monochromator requires in general alignment operation with a translational movement of the sample unit.

A further improvement, which requires no translational movement of the sample unit either, is to use a four-crystal monochromator as disclosed in, for example, Japanese patent publication Nos. JP 59-108945 A (1984) and JP 4-264299 A (1992). The four-crystal monochromator is composed of two channel-cut monochromators arranged to be mirror-symmetrical. The four-crystal monochromator produces a highly-monochromatic and highly-parallel output X-ray beam which is also on the extension line of the incident X-ray beam. Using the X-ray beam produced by the four-crystal monochromator, a high-resolution rocking curve of a sample is always obtained without depending upon the kind of the sample crystal and its object Miller indices. Using the four-crystal monochromator however, the output X-ray beam inadvantageously has a very low intensity which would be about one hundredth of that produced by the double crystal method. Thus the use of the four-crystal monochromator has some problems: (1) it requires a high-power X-ray source which is expensive; and (2) it takes a long time to measure the rocking curve for accumulating the intensity. Therefore, the four-crystal monochromator would be limited to have only such reflecting surfaces that its Miller indices can produce a high-intensity X-ray beam.

Next, the state of art in X-ray analysis using a high-resolution X-ray diffractometer is described below. As a thin film technique spreads, object samples of the high-resolution X-ray diffractometer spread from the conventional bulk crystals toward film crystals on substrates. The crystal state of the film is in variety and classified to (1) a perfect epitaxial layer (pseudomorphic layer), (2) an epitaxial layer in which dislocations occur in a boundary between a substrate crystal and the epitaxial layer for strain relaxation, (3) an epitaxial layer having an orientation distribution (mosaicity), (4) a polycrystalline thin film having strong preferred orientation, (5) a polycrystalline thin film having no preferred orientation and (6) an amorphous thin film.

Under the circumstances, the high-resolution X-ray diffractometer has been expected to have various functions so as to measure not only the rocking curves mentioned above but also reflection coefficient (near the total reflection region with glancing incident angles) and polycrystalline film X-ray diffraction.

Therefore, various incident optical systems have to be prepared to regulate, according to the sample state, the parallelism and the wavelength range of X-rays which are incident on a sample. Such an incident optical system may be a module-type incident optical unit which can be exchanged for another or an incident optical system which can be switched to another state without removing a crystal as disclosed in, for example, Japanese patent publication No. JP 9-49811 A (1997). However, the exchange of the module-type incident optical unit is expensive because various optical units must be prepared and exchanged and the fine tuning after the exchange would be troublesome.

The switchover of the incident optical system disclosed in Japanese patent publication No. JP 9-49811 A (1997) can select one of the following four incident optical systems.

(1) Taking out the direct beam. That is, an X-ray beam is not reflected by the crystal and passes through as it is. This incident optical system is usable mainly for polycrystalline thin film diffraction.

(2) A channel-cut monochromator optical system. This system has a channel-cut crystal using Ge {220} reflection by which X-rays are reflected two times, so that CuK$\alpha$2 is removed and CuK$\alpha$1 only is taken out. This incident optical system is usable mainly for reflection coefficient measurement.

(3) A high-intensity mode of four-crystal monochromator. This incident optical system has a combination of two channel-cut monochromators using Ge {220} reflection and usable for rocking curve measurement of epitaxial layers for example.

(4) A high-resolution mode of four-crystal monochromator. This incident optical system has a combination of two channel-cut monochromators using Ge {440} reflection. Since this system has very high resolution, it is usable for rocking curve measurement of perfect epitaxial layers for example.

The switchover of the four incident optical systems is carried out by CPU control in a manner that some adjusting members are adjusted to the predetermined value, this switchover operation being easy. However, if a new incident optical system other than the four systems would be desired, an optional crystal is required. The optional crystal can be installed as explained below. First, a mechanical clamp is loosed to remove a crystal along with its holder block from the incident optical system. Then, a holder block having the optional crystal is mechanically clamped, noting that the position and the angle of the newly clamped crystal are not always accurate because they depend upon the clamping force and so on. Accordingly, it is necessary to re-adjust the optical system or at least to set at the former adjusted value and carry out fine tuning thereafter, this operation being troublesome.

The optional crystal may be one of the following monochromators:

(1) An asymmetrical-reflection channel-cut monochromator which condenses the beam width. This monochromator is used for increasing the X-ray beam intensity. When the asymmetrical reflection with which the output X-ray beam width becomes narrower than the incident X-ray beam width is used, an output X-ray beam intensity per unit width is increased but the angular resolution is lowered as compared with the symmetrical reflection. This monochromator is used for measurement of X-ray reflection coefficient of a thin film. The X-ray reflection coefficient method can evaluate a thickness and a density of a thin film and a density of a surface or a boundary. When the method is applied to a very thin film to make analysis with high accuracy, it is necessary to measure intensity variation of X-rays reflected by a thin film in an angular range from a grazing incident angle to about ten degrees with a dynamic range of eight figures or more. This requires a narrow-width, high-intensity monochromatic X-ray beam which is obtained using the asymmetrical-reflection channel-cut monochromator condensing the beam width.

(2) An asymmetrical-reflection channel-cut monochromator which expands the beam width. This monochromator uses such an asymmetrical reflection that the output X-ray beam width becomes broader than the incident X-ray beam width in contrast to the above-mentioned beam-width condensation. An output X-ray beam intensity per unit width is decreased but the angular resolution is advanced. This monochromator is used for X-ray topography because an image area covered by one measurement is large.

(3) A channel-cut monochromator with quasi parallel arrangement. That is, the d-value of the channel-cut crystal is almost identical with that of a sample crystal. Using this monochromator, a high-intensity, high-resolution rocking curve is obtained. Since there is a tendency that the thickness of an epitaxial layer becomes thinner and thinner, an intensity of diffracted X-rays from the epitaxial layer would be not enough in some cases, this monochromator being usable for such cases. Furthermore, this monochromator is also usable for the following cases for which the four-crystal monochromator is not usable because of its weak intensity of the output X-ray beam. (a) When a sample crystal is curved, an X-ray irradiation width on the sample should be narrowed to avoid influence of the curve. In this case, the X-ray intensity is low. (b) When a small region of a selectively-deposited layer is analyzed, it is required to narrow an X-ray beam in width and height and to aim the X-ray beam at the target region. In this case, the X-ray beam is narrowed to have a cross-section of about 20 micrometers wide and 50 micrometers high, the X-ray intensity being small. (c) When an epitaxial thin film crystal is analyzed, a certain evaluation method has been established such that a sample is measured using two or more diffraction vectors. For example, for investigating whether or not strain relaxation occurs in the boundary, there is observed usually not only {400} symmetrical reflection but also {511} and {422} asymmetrical reflection. The all kinds of reflection can be measured satisfactorily with a high-resolution using the four-crystal monochromator. However, in case that the weak intensity becomes an issue as described in the above terms (a) and (b), the four-crystal monochromator would be insufficient and provides no efficient measurement. After all, in case that the weak intensity becomes an issue, the "double crystal method" is effective in which both a high-resolution and a high-intensity are obtained with the use of a channel-cut monochromator which is in a quasi parallel arrangement for the object lattice plane of a sample crystal, noting that it requires exchange of the monochromator crystal and an alignment operation thereafter.

As has been described in detail, in the field of the high-resolution X-ray diffractometer, the double crystal method is effective for obtaining both a high resolution and a high intensity. Using the double crystal method, however, for measurement under various conditions, it is necessary to exchange the incident optical unit or switch the incident optical system, it being troublesome.

SUMMARY OF THE INVENTION

It is an object of the invention to provide a channel-cut monochromator which is manufactured by processing a plurality of grooves on a common crystal block and can be rotated to switch the reflection Miller indices or select symmetrical or asymmetrical reflection.

A channel-cut monochromator according to the invention comprises at least two, preferably three or more, kinds of reflecting surface pairs processed on a common single crystal block. Each reflecting surface pair has a first and a second reflecting surfaces between which an X-ray beam is reflected even-number times (typically two times, or four or six times being usable). This channel-cut monochromator can be rotated around an axis of rotation perpendicular to a reference plane so as to switch the reflecting surface pair which reflects X-rays. Any one of the reflecting surface pairs is composed of two reflecting surfaces perpendicular to the reference plane, and an X-ray beam incident on any reflecting surface pair or its extension line is tangent to a common imaginary circle whose center coincides with the axis of rotation. With this structure, the switchover of the reflecting surface pair is accomplished by only rotation of the channel-cut monochromator around its axis of rotation, so that X-ray beams reflected by various Miller indices can be taken out selectively.

The channel-cut monochromator may have a direct path through which an X-ray beam passes in no contact with any reflecting surface. The X-ray beam passing through the direct path passes through the channel-cut monochromator so as to be tangent to the imaginary circle. With the direct path, an X-ray beam can pass through as it is without escaping the channel-cut monochromator from the optical axis.

The channel-cut monochromator may have more preferably five or more reflecting surface pairs. For example, the channel-cut monochromator may be made of silicon or germanium single crystal and may have at least five kinds of reflecting surface pairs for {220}, {400}, {422}, {511} and {111} reflection. The reflecting surface pair for {220} reflection is also usable for taking out an X-ray beam of {440} reflection. The {220} and {440} reflection is usable for the four-crystal monochromator. An X-ray beam from {111} and {220} reflection has comparatively a high intensity and is usable for measurement of reflection coefficient. On the other hand, an X-ray beam from {400}, {422} and {511} reflection is usable for a parallel arrangement or quasi parallel arrangement in the double crystal method.

The channel-cut monochromator may have at least one reflecting surface pair having one or two asymmetrical reflecting surfaces. The asymmetrical reflecting surface may be a type of condensing an X-ray beam width or a type of expanding an X-ray beam width. Only one of the two reflecting surfaces composing a reflecting surface pair may be asymmetrical or both of them may be asymmetrical.

Since the channel-cut monochromator of the invention is made of a common single crystal block having at least two kinds of reflecting surface pairs and is rotated to switch the reflecting surface pair, various X-ray beams reflected by various Miller indices can be taken out selectively. Specifically, some kinds of reflecting surface pairs having Miller indices suitable for measurement of reflection coefficient or measurement using the four-crystal monochromator and other kinds of reflecting surface pairs having Miller indices which require the double crystal method both can be formed on the common single crystal block, so that these Miller indices can be switched easily. The switchover of the Miller indices can be carried out by only rotation of the channel-cut monochromator and, if necessary, the translational movement of the sample unit, so that the switchover operation is easy.

DETAILED DESCRIPTION OF THE PREFERRED EMBODIMENTS

First of all, the expression of crystal lattice plane indices (Miller indices) will be briefly explained. A germanium crystal and a silicon crystal, which are used in embodiments of the invention, each has a crystal structure of cubic lattice, so that there are six lattice planes equivalent to (100) plane. These equivalent planes are represented by {100} in general. Similarly, there are six directions equivalent to [100] direction, these equivalent directions being represented by <100>. This specification uses such general expressions.

Figure 1:
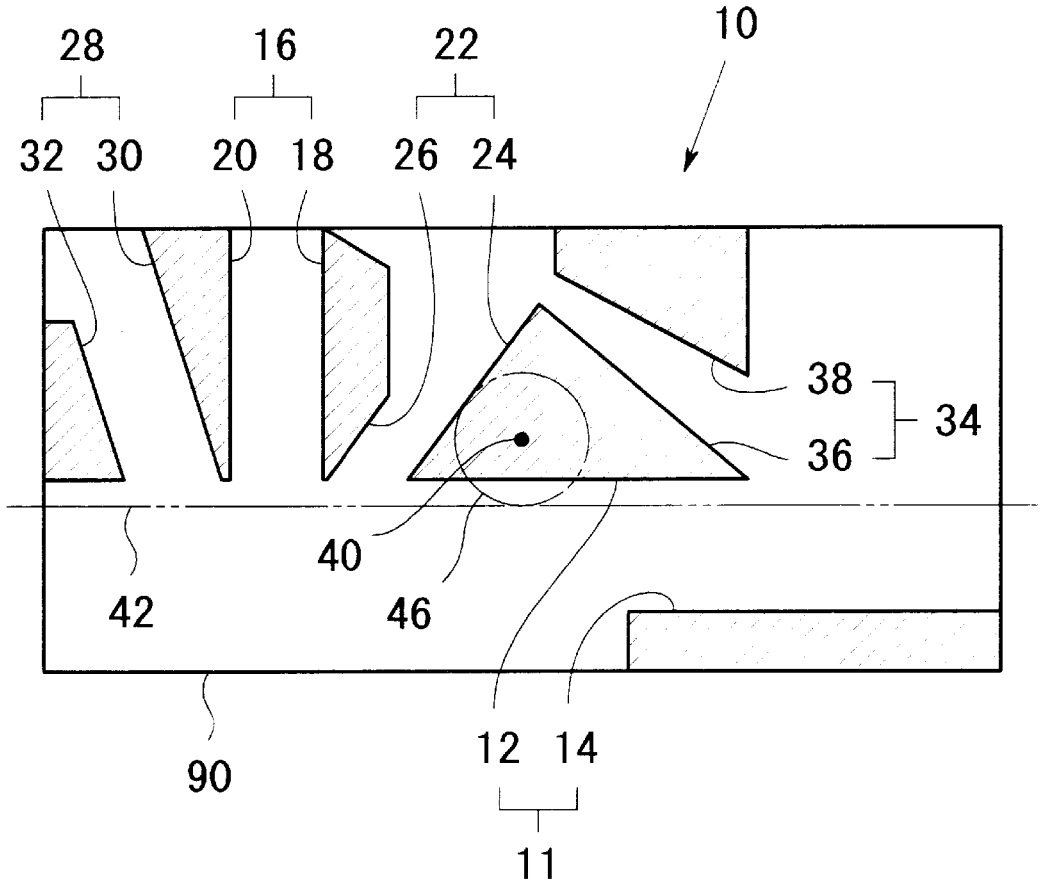
FIG. 1 is a plan view of the first embodiment of the invention.
Figure 2:
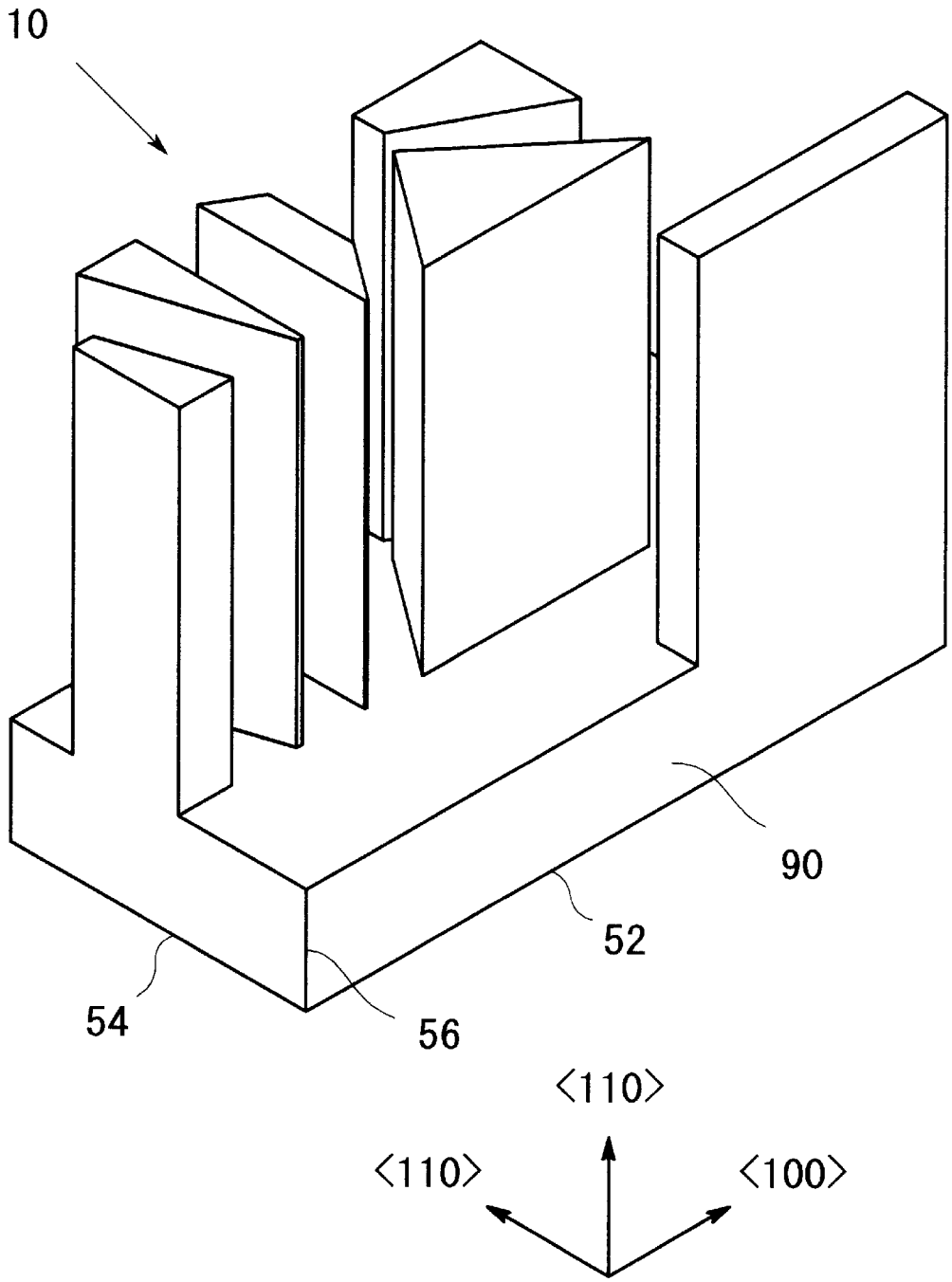
FIG. 2 is a perspective view of the channel-cut monochromator shown in FIG. 1.

FIG. 1 is a plan view of the first embodiment of the invention and FIG. 2 is its perspective view. Referring to FIG. 2, a channel-cut monochromator 10 is made of a germanium single crystal block. The block is a parallelepiped of 35 mm long, 20 mm wide and 25 mm high and has five kinds of reflecting surface pairs formed by processing grooves on the block. Each groove is 20 mm deep and therefore each reflecting surface is 20 mm high. The channel-cut monochromator has a bottom surface which can be a reference plane. The block has been cut so as to be a parallelepiped having a crystallographic axis shown in FIG. 2. That is, a longitudinal edge 52 is parallel to <100> direction, a lateral edge 54 is parallel to <110> direction and a vertical edge 56 is parallel to <110> direction. The grooves can be machined by a diamond wheel machine, a diamond-tool NC milling machine or a supersonic processing machine.

Referring to FIG. 1, the first reflecting surface pair 11 is composed of two reflecting surfaces 12 and 14 parallel to each other for diffracting X-rays by Ge{220} or Ge{440} plane. That is, the reflecting surfaces 12 and 14 are so processed as to be parallel to {220} and {440} planes of germanium single crystal. The {220} and {440} planes are parallel to each other and are different in interplaner spacing (d-value) only. The reflecting surfaces 12 and 14 are parallel to a longitudinal side 90 of the single crystal block.

The second reflecting surface pair 16 is composed of two reflecting surfaces 18 and 20 parallel to each other for diffracting X-rays by Ge {400} plane. That is, the reflecting surfaces 18 and 20 are so processed as to be parallel to {400} plane of germanium single crystal. The reflecting surfaces 18 and 20 are perpendicular to the longitudinal side 90.

The third reflecting surface pair 22 is composed of two reflecting surfaces 24 and 26 parallel to each other for diffracting X-rays by Ge {422} plane. That is, the reflecting surfaces 24 and 26 are so processed as to be parallel to {422} plane of germanium single crystal. The reflecting surfaces 24 and 26 are inclined by 54.7 degrees to the longitudinal side 90.

The fourth reflecting surface pair 28 is composed of two reflecting surfaces 30 and 32 parallel to each other for diffracting X-rays by Ge {511} plane. That is, the reflecting surfaces 30 and 32 are so processed as to be parallel to {511} plane of germanium single crystal. The reflecting surfaces 30 and 32 are inclined by 74.4 degrees to the longitudinal side 90.

The fifth reflecting surface pair 34 is composed of two reflecting surfaces 36 and 38 parallel to each other for diffracting X-rays by Ge {111} plane. Although the reflecting surface 36 is parallel to {111} plane of germanium single crystal, the other reflecting surface 38 is not parallel to {111} plane of germanium single crystal. That is, the reflecting surface 38 is an asymmetrical reflecting surface for condensing a beam width. The reflecting surface 36 is inclined by 35.3 degrees to the longitudinal side 90.

There is a direct path between the two reflecting surfaces 12 and 14 of the first reflecting surface pair 11. An X-ray beam 42 can pass through the direct path in no contact with any reflecting surfaces.

Figure 3:
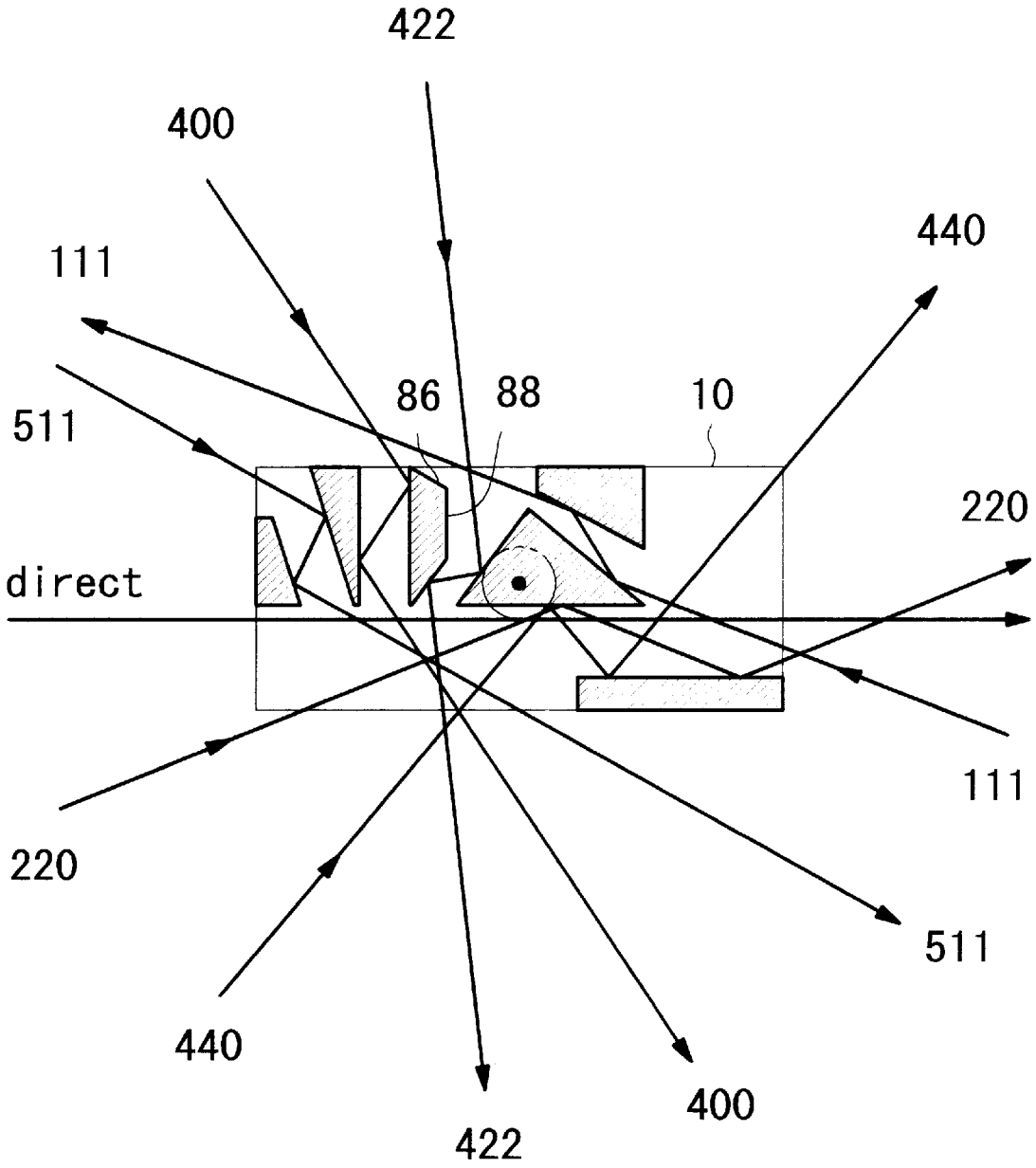
FIG. 3 is a plan view showing a manner in which X-rays coming from in seven kinds of directions are reflected by or pass through the channel-cut monochromator shown in FIG. 1.

Surfaces other than the reflecting surfaces mentioned above, for example, side surfaces 86 and 88 shown in FIG. 3, have been suitably cut off so as not to intercept various incident X-ray beams and output X-ray beams.

In FIG. 1, the channel-cut monochromator 10 can be rotated around an axis of rotation 40 which extends perpendicularly to the drawing sheet. The five kinds of reflecting surface pairs are designed based on an imaginary circle 46 whose center coincides with the axis of rotation 40. That is, each reflecting surface pair is so designed that an X-ray beam incident on the reflecting surface pair or its extension line is tangent to the imaginary circle 46 whose radius is 2.5 mm. In this embodiment, an X-ray beam is reflected two times (i.e., one time at each reflecting surface of the pair) at all of the five kinds of reflecting surface pairs and then goes out from the monochromator. Each reflection surface of the five kinds of reflection surface pairs is perpendicular to the reference plane. The axis of rotation 40 of the monochromator is also perpendicular to the reference plane.

FIG. 3 is a plan view showing a manner in which X-rays coming from in seven kinds of directions are reflected by or pass through the channel-cut monochromator shown in FIG. 1. The X-ray beam indicated by "direct" is to pass through the monochromator 10 in no contact with any reflecting surface. The X-ray beam indicated by "220" is to be reflected by {220} plane of germanium crystal. Similarly, the X-ray beams indicated by 440, 400, 422, 511 and 111 are to be reflected by {440}, {400}, {422}, {511} and {111} planes of germanium crystal. It is noted that a direction perpendicular to the drawing sheet coincides with <110> direction of the germanium crystal.

Although FIG. 3 shows various directions of incident X-ray beams with the channel-cut monochromator 10 being stationary, the incident X-ray beam is generally always in the same direction in the actual high-resolution X-ray diffractometer, so that the channel-cut monochromator 10 is rotated to alter the direction of the incident X-ray beam to the monochromator. There will be described hereinafter, with referring to drawings, the seven states of monochromator rotation for seven directions of the incident X-ray beams.

Figure 4:
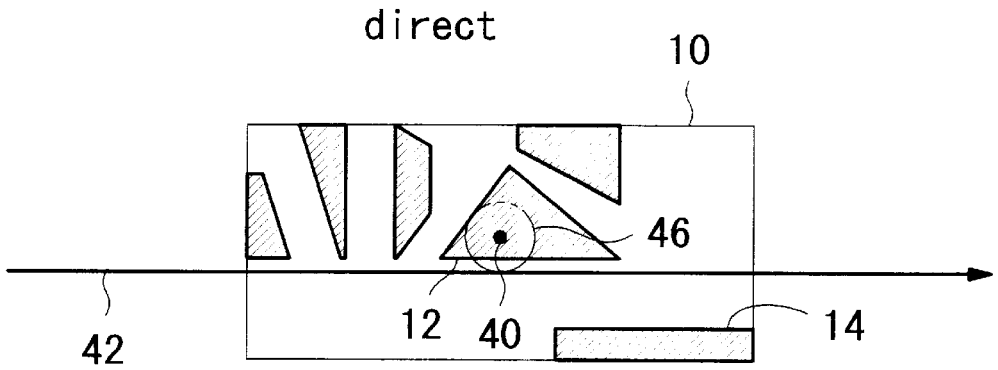
FIG. 4 is a plan view showing a state in which the channel-cut monochromator shown in FIG. 1 is so rotated that an X-ray beam passes through a direct path.

FIG. 4 shows a state in which an X-ray beam 42 passes through the direct path. The channel-cut monochromator 10 is so rotated and adjusted around the axis of rotation 40 that the reflecting surfaces 12 and 14 become parallel to the X-ray beam 42. The X-ray beam 42 passes through the channel-cut monochromator 10 so as to be tangent to the imaginary circle 46, so that the X-ray beam 42 is in no contact with any reflecting surface. The distance between the reflecting surface 12 and the X-ray beam 42 is 1 mm. This direct beam is usable for X-ray diffraction measurement of a polycrystalline thin film.

Figure 5:
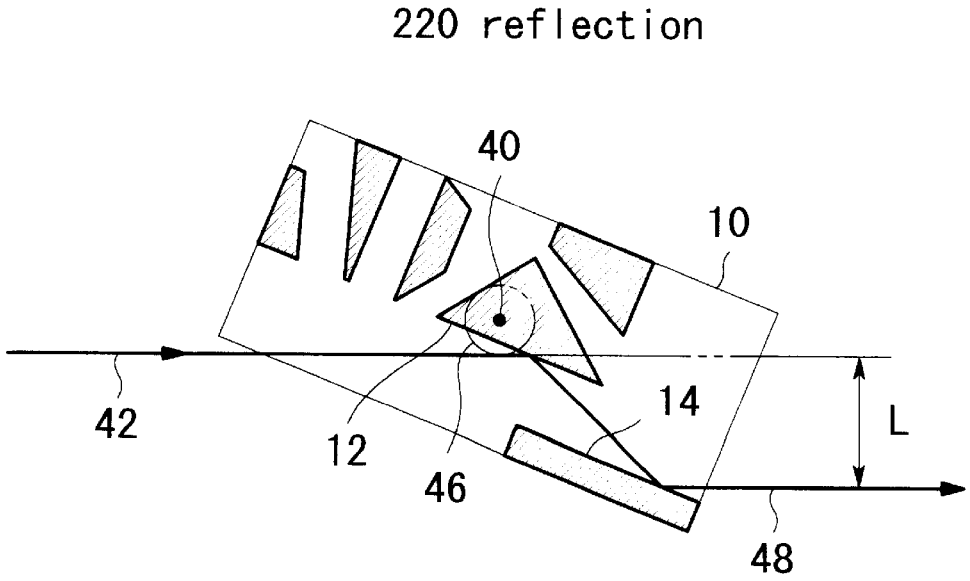
FIG. 5 is a plan view showing a state in which the channel-cut monochromator shown in FIG. 1 is so rotated that an X-ray beam is diffracted by {220} plane.
Figure 11:
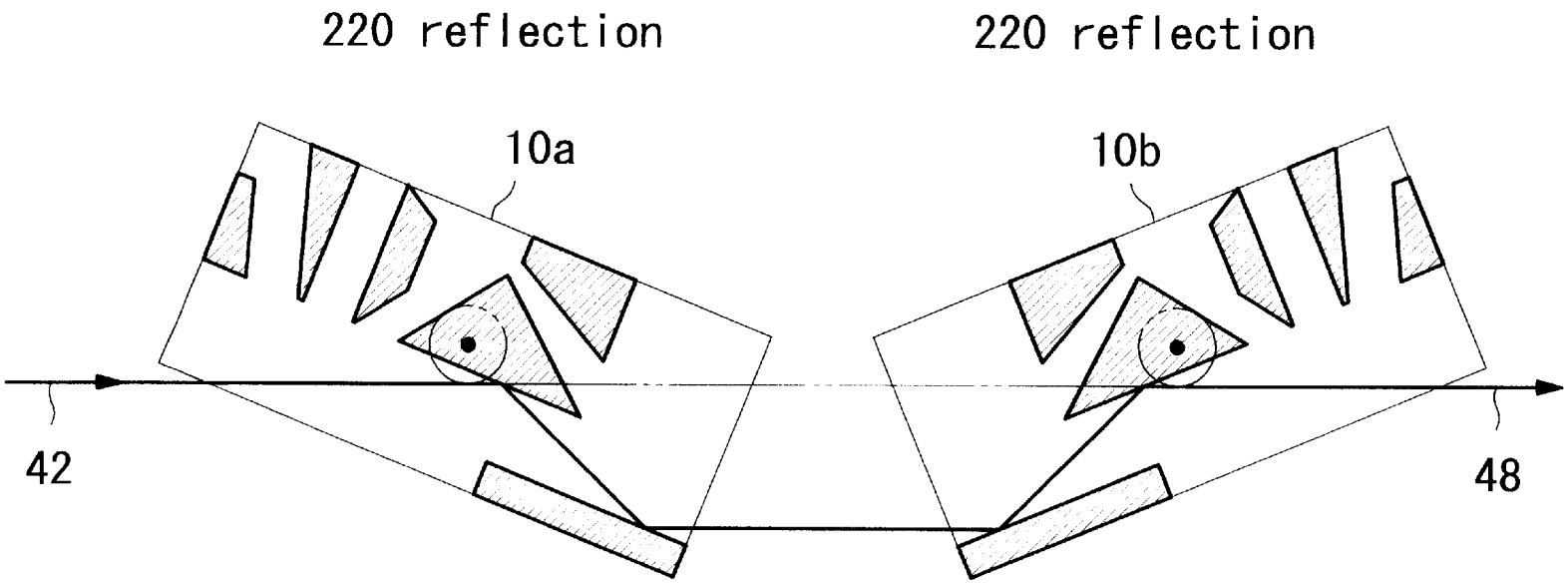
FIG. 11 is a plan view showing a combination of two channel-cut monochromators shown in FIG. 1, the combination being usable as the four-crystal monochromator.

FIG. 5 shows a state in which an X-ray beam is diffracted by {220} plane of germanium crystal. The channel-cut monochromator 10 is so rotated around the axis of rotation 40 that the first reflecting surface 12 of the first reflecting surface pair is inclined by 22.65 degrees to the X-ray beam 42. Stating in detail, the channel-cut monochromator 10 is rotated clockwise by 22.65 degrees from the state shown in FIG. 4. The X-ray incident angle value to the first reflecting surface 12 is determined by the wavelength of the used characteristic X-ray (CuKα1 in the embodiment), the d-value of {220} plane of germanium crystal and the Bragg's law. The X-ray beam 42 is incident so as to be tangent to the imaginary circle 46. The X-ray beam 42 is incident on the first reflecting surface 12 and diffracted by {220} plane of germanium crystal and then is incident on the second reflecting surface 14 and similarly diffracted by {220} plane to go out as an output X-ray beam 48. The X-ray beam 48 becomes parallel to the incident X-ray beam 42 but is shifted translationally by a distance L. Therefore, if an X-ray beam was incident on the desired region of a sample in the state shown in FIG. 4, it is necessary to shift the sample translationally by the distance L for irradiating the same desired region when the optical system is altered to the state shown in FIG. 5. Of course, the X-ray source requires no movement. An X-ray beam from this {220} reflection has comparatively a high intensity and is suitable for reflection coefficient measurement (near the total reflection region with glancing incident angles). The {220} reflection is also suitable for the four-crystal monochromator, as shown in FIG. 11 explained below, for obtaining the rocking curve.

Figure 6:
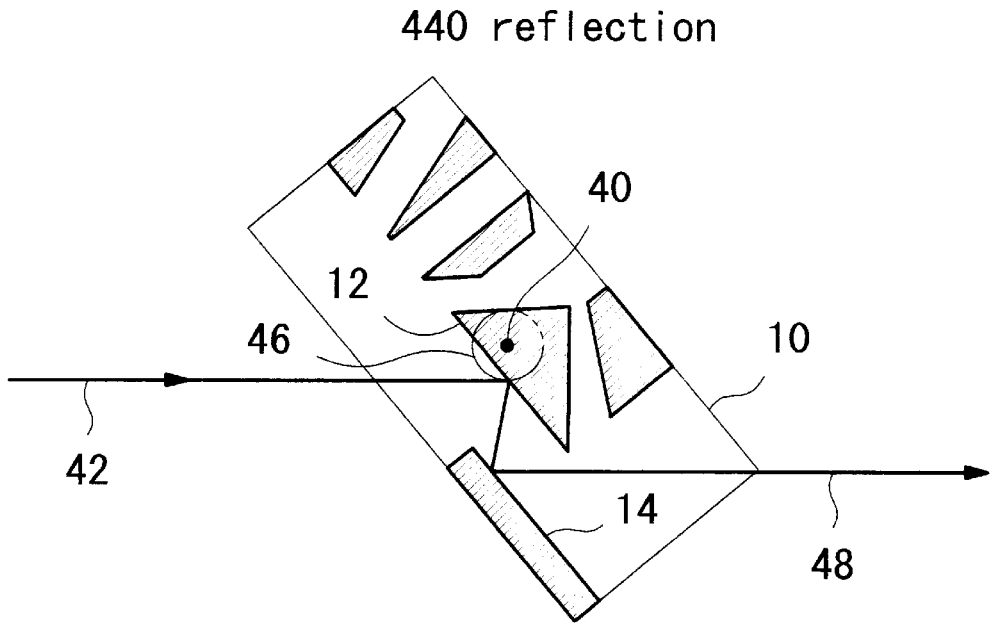
FIG. 6 is a plan view showing a state in which the channel-cut monochromator shown in FIG. 1 is so rotated that an X-ray beam is diffracted by {440} plane.

FIG. 6 shows a state in which an X-ray beam is diffracted by {440} plane of germanium crystal. A reflecting surface pair to be used is the first reflecting surface pair (reflecting surfaces 12 and 14) which is the same pair as for {220} reflection shown in FIG. 5. Since {440} plane and {220} plane are parallel to each other, the same reflection surface pair can be used, noting that the d-values are different so that the incident angle of the X-ray beam 42 to the reflecting surface 12 should be altered. That is, the channel-cut monochromator 10 is so rotated around the axis of rotation 40 that the first reflecting surface 12 is inclined by 50.38 degrees to the X-ray beam 42. Stating in detail, the channel-cut monochromator 10 is rotated clockwise by 50.38 degrees from the state shown in FIG. 4. The X-ray beam 42 is incident so as to be tangent to the imaginary circle 46. The X-ray beam 42 is incident on the first reflecting surface 12 and diffracted by {440} plane of germanium crystal and then is incident on the second reflecting surface 14 and similarly diffracted by {440} plane to go out as an output X-ray beam 48. The X-ray beam 48 becomes parallel to the incident X-ray beam 42 but is shifted translationally by a distance which is different from that in FIG. 5. An X-ray beam from this {440} reflection has a lower intensity than that from {220} reflection but a high resolution and is suitable for the four-crystal monochromator, as shown in FIG. 11 explained below, for obtaining rocking curves.

Figure 7:
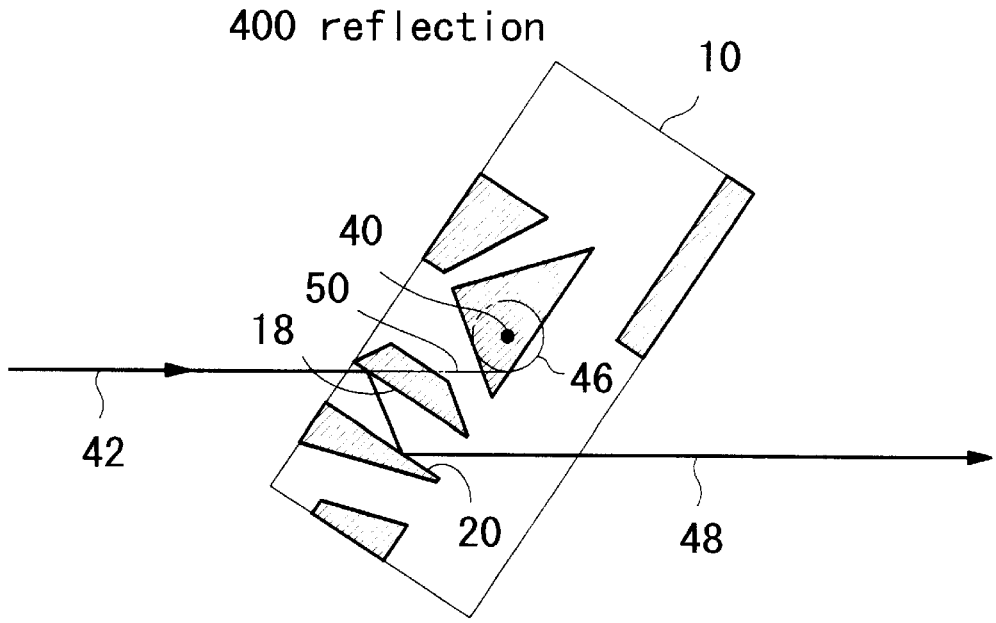
FIG. 7 is a plan view showing a state in which the channel-cut monochromator shown in FIG. 1 is so rotated that an X-ray beam is diffracted by {400} plane.

FIG. 7 shows a state in which an X-ray beam is diffracted by {400} plane of germanium crystal. The channel-cut monochromator 10 is so rotated around the axis of rotation 40 that the first reflecting surface 18 of the second reflecting surface pair is inclined by 33.0 degrees to the X-ray beam 42. Stating in detail, the channel-cut monochromator 10 is rotated counterclockwise by 57.0 degrees from the state shown in FIG. 4. The X-ray beam 42 is incident so that its extension line 50 is tangent to the imaginary circle 46. The X-ray beam 42 is incident on the first reflecting surface 18 and diffracted by {400} plane of germanium crystal and then is incident on the second reflecting surface 20 and similarly diffracted by {400} plane to go out as an output X-ray beam 48. An X-ray beam from this {400} reflection is suitable for obtaining rocking curves with the quasi parallel arrangement. That is, when the rocking curve of GaAs {400} plane (or an epitaxial layer growing thereon) is measured, an X-ray beam diffracted by {400} plane of germanium crystal can be used to make the quasi parallel arrangement of the double crystal method. The d-value of {400} plane of germanium crystal is close to the d-value of GaAs {400} plane to be measured.

Figure 8:
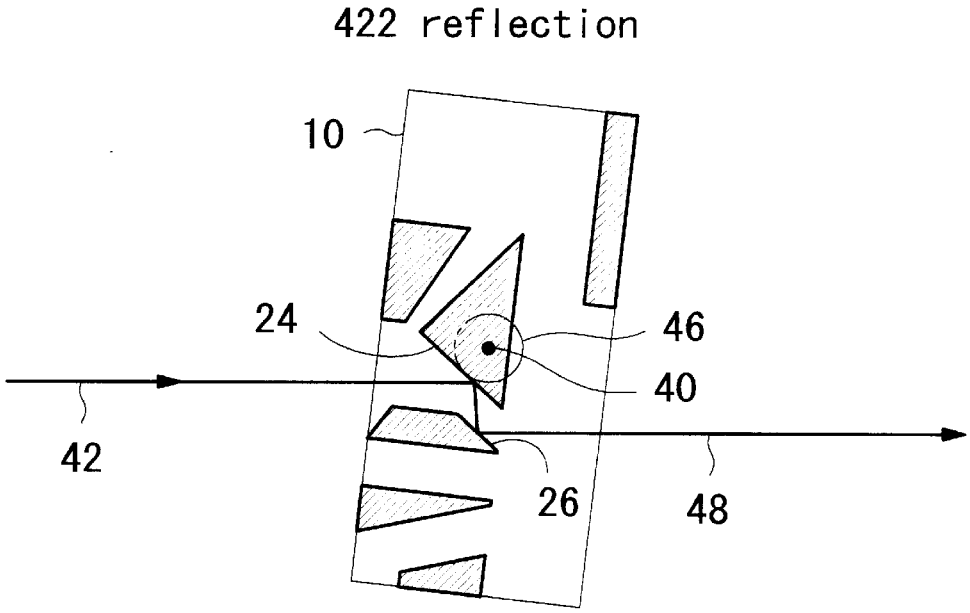
FIG. 8 is a plan view showing a state in which the channel-cut monochromator shown in FIG. 1 is so rotated that an X-ray beam is diffracted by {422} plane.

FIG. 8 shows a state in which an X-ray beam is diffracted by {422} plane of germanium crystal. The channel-cut monochromator 10 is so rotated around the axis of rotation 40 that the first reflecting surface 24 of the third reflecting surface pair is inclined by 41.84 degrees to the X-ray beam 42. Stating in detail, the channel-cut monochromator 10 is rotated counterclockwise by 83.46 degrees from the state shown in FIG. 4. The X-ray beam 42 is incident so that its extension line is tangent to the imaginary circle 46. The X-ray beam 42 is incident on the first reflecting surface 24 and diffracted by {422} plane of germanium crystal and then is incident on the second reflecting surface 26 and similarly diffracted by {422} plane to go out as an output X-ray beam 48. An X-ray beam from this {422} reflection is suitable for obtaining rocking curves with the quasi parallel arrangement. That is, when the rocking curve of an asymmetrical {422} plane of GaAs (or an epitaxial layer growing thereon) is measured, an X-ray beam diffracted by {422} plane of germanium crystal can be used to make the quasi parallel arrangement of the double crystal method.

Figure 9:
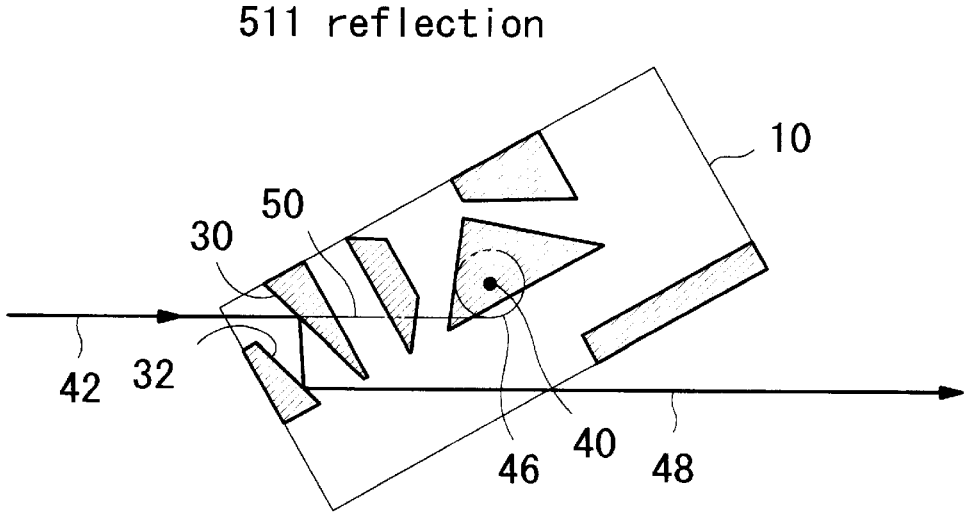
FIG. 9 is a plan view showing a state in which the channel-cut monochromator shown in FIG. 1 is so rotated that an X-ray beam is diffracted by {511} plane.

FIG. 9 shows a state in which an X-ray beam is diffracted by {511} plane of germanium crystal. The channel-cut monochromator 10 is so rotated around the axis of rotation 40 that the first reflecting surface 30 of the fourth reflecting surface pair is inclined by 45.03 degrees to the X-ray beam 42. Stating in detail, the channel-cut monochromator 10 is rotated counterclockwise by 29.37 degrees from the state shown in FIG. 4. The X-ray beam 42 is incident so that its extension line 50 is tangent to the imaginary circle 46. The X-ray beam 42 is incident on the first reflecting surface 30 and diffracted by {511} plane of germanium crystal and then is incident on the second reflecting surface 32 and similarly diffracted by {511} plane to go out as an output X-ray beam 48. An X-ray beam from this {511} reflection is suitable for obtaining rocking curves with the quasi parallel arrangement. That is, when the rocking curve of an asymmetrical {511} plane of GaAs (or an epitaxial layer growing thereon) is measured, an X-ray beam diffracted by {511} plane of germanium crystal can be used to make the quasi parallel arrangement of the double crystal method.

Figure 10A:
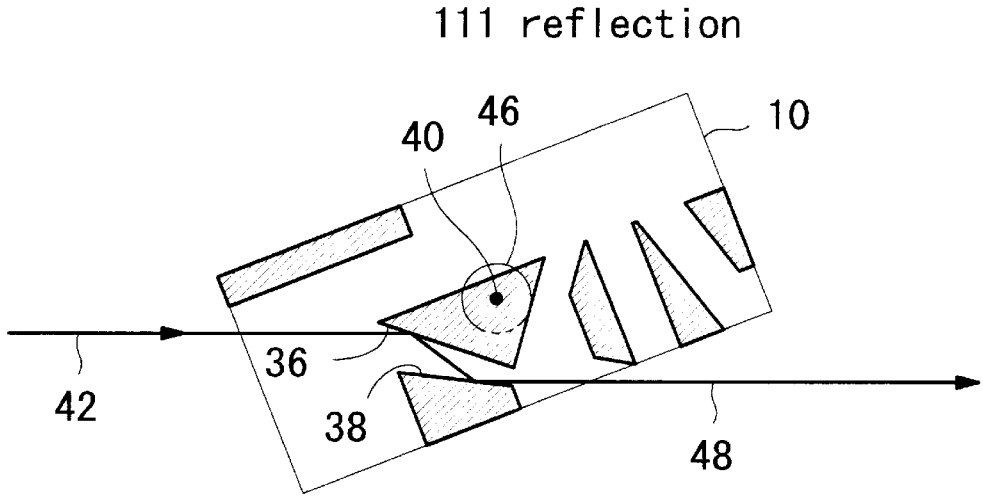
FIGS. 10*a* and 10*b* are plan views showing a state in which the channel-cut monochromator shown in FIG. 1 is so rotated that an X-ray beam is diffracted by {111} plane.
Figure 10B:
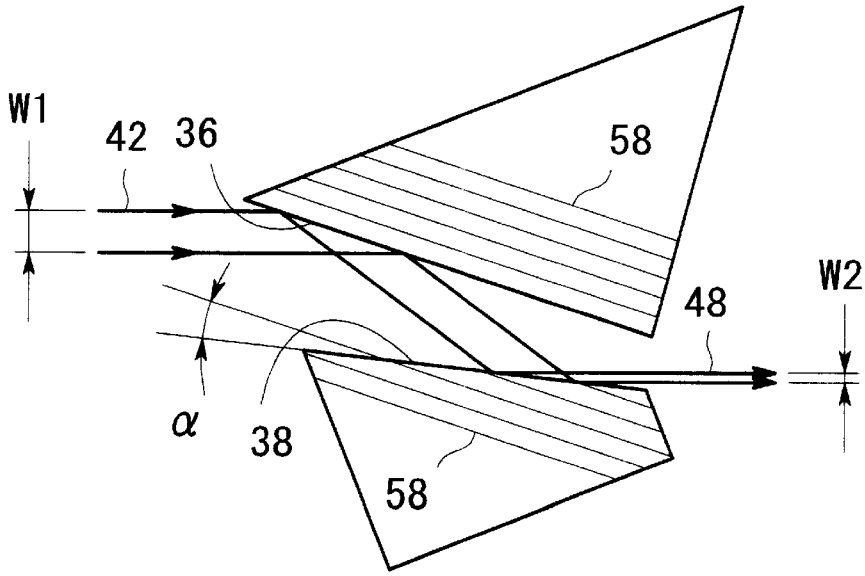

FIG. 10*a* shows a state in which an X-ray beam is diffracted by {111} plane of germanium crystal. The channel-cut monochromator 10 is so rotated around the axis of rotation 40 that the first reflecting surface 36 of the fifth reflecting surface pair is inclined by 13.64 degrees to the X-ray beam 42. Stating in detail, the channel-cut monochromator 10 is rotated clockwise by 158.34 degrees from the state shown in FIG. 4. The X-ray beam 42 is incident so that its extension line is tangent to the imaginary circle 46. The X-ray beam 42 is incident on the first reflecting surface 36 and diffracted by {111} plane of germanium crystal and then is incident on the second reflecting surface 38 which is not parallel to the first reflecting surface 36 as described in detail below. FIG. 10*b* is an enlarged plan view of the vicinity of the fifth reflecting surface pair. Although the first reflecting surface 36 is parallel to {111} plane 58 of the germanium crystal, the second reflecting surface 38 is inclined counterclockwise by $\alpha$=10.7 degrees to {111} plane 58. When an X-ray beam is diffracted by {111} plane 58 of the germanium crystal at the second reflecting surface 38, the X-ray beam width is condensed to one eighth. That is, the beam width W2 of the output X-ray beam 48 becomes one eighth of the beam width W1 of the incident X-ray beam 42. For example, when the beam width of the incident X-ray beam 42 is 0.8 mm, the beam width of the output X-ray beam 48 becomes 0.1 mm. The condensed X-ray beam 48 from this asymmetrical {111} reflection has comparatively a high intensity and is suitable for reflection coefficient measurement.

Figure 18:
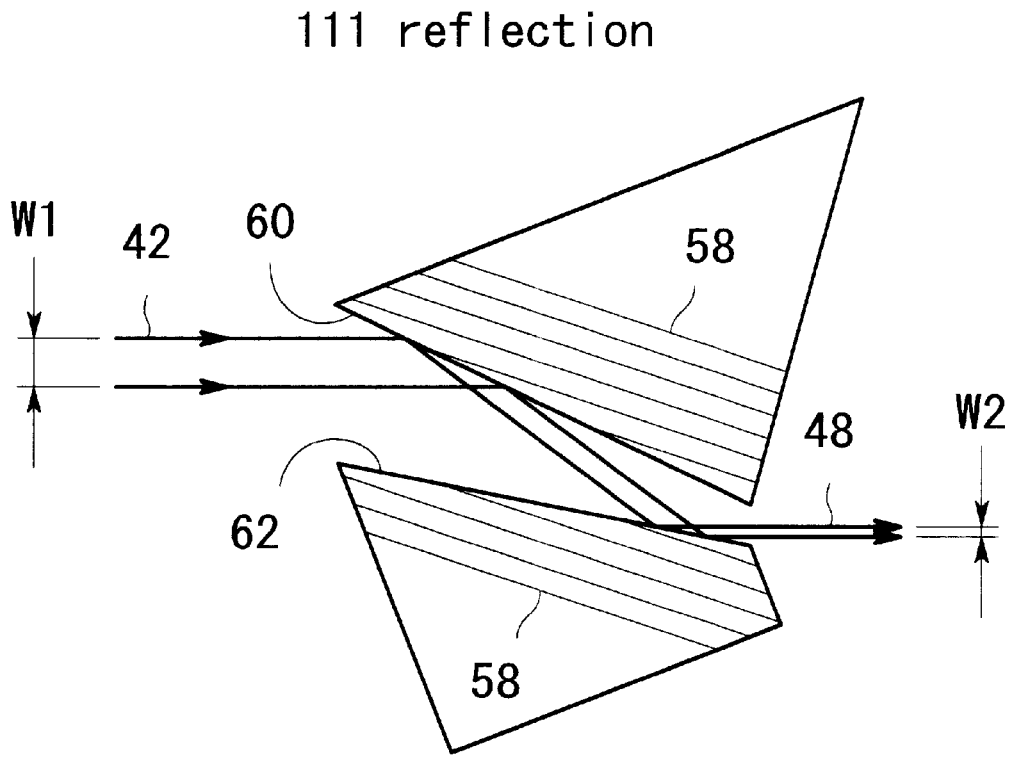
FIG. 18 is a plan view showing a modification of the channel-cut monochromator shown in FIG. 1 in which the fifth reflecting surface pair is composed of two asymmetrical reflecting surfaces.

The fifth reflecting surface pair may have two asymmetrical reflecting surfaces. FIG. 18 is an enlarged plan view showing such a modification. The first reflecting surface 60 is inclined clockwise by 7.2 degrees to {111} plane 58 of the germanium crystal while the second reflecting surface 62 is inclined counterclockwise by 7.2 degrees to {111} plane 58 of the germanium crystal. An incident X-ray beam 42 is diffracted by {111} plane 58 at the first reflecting surface 60 to have a beam width condensed to $1/3.16$ (a square root of one tenth). It is further diffracted by {111} plane 58 also at the second reflecting surface 62 to have a beam width further condensed to $1/3.16$ (a square root of one tenth). As a result, the beam width W2 of the output X-ray beam 48 becomes one tenth of the beam width W1 of the incident X-ray beam 42.

The channel-cut monochromator according to the invention may include two or more kinds of reflecting surface pairs each having one or two asymmetrical reflecting surface. Besides, not only the condensing-type asymmetrical reflecting surface but also the expanding-type asymmetrical reflecting surface may be used.

The channel-cut monochromator shown in FIG. 1 may be combined with itself to form the four-crystal monochromator. FIG. 11 is a plan view showing such an application. Two channel-cut monochromators 10*a* and 10*b* are arranged so as to be mirror symmetrical. Each channel-cut monochromator is so adjusted in posture that X-rays are diffracted by {220} plane of germanium crystal. An incident X-ray beam 42 is reflected by the first reflecting surface pair of the first channel-cut monochromator 10*a* and further reflected by the first reflecting surface pair of the second channel-cut monochromator 10*b* to go out as an output X-ray beam 48. The output X-ray beam 48 is on the same straight line as the incident X-ray beam 42. It is noted that the right-side channel-cut monochromator 10*b* may be an ordinary channel-cut monochromator having only one reflecting surface pair for {220} reflection. In stead of {220} reflection, {440} reflection of the germanium crystal may be combined with itself similarly to form the four-crystal monochromator.

Although the channel-cut monochromator 10 is made of germanium single crystal in the embodiment described above, it may be made of silicon single crystal. X-ray beams reflected by {400}, {422} and {511} planes of the silicon crystal are usable, as in the case of germanium, for measurement of GaAs samples with the quasi parallel arrangement of the double crystal method.

Figure 12:
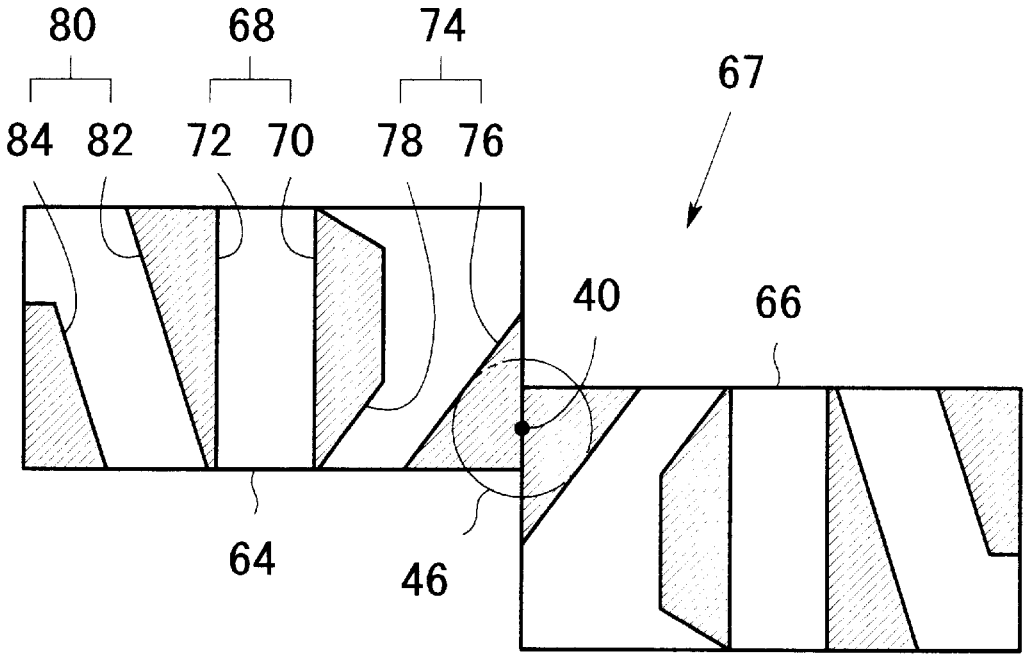
FIG. 12 is a plan view of the second embodiment of the invention.
Figure 13:
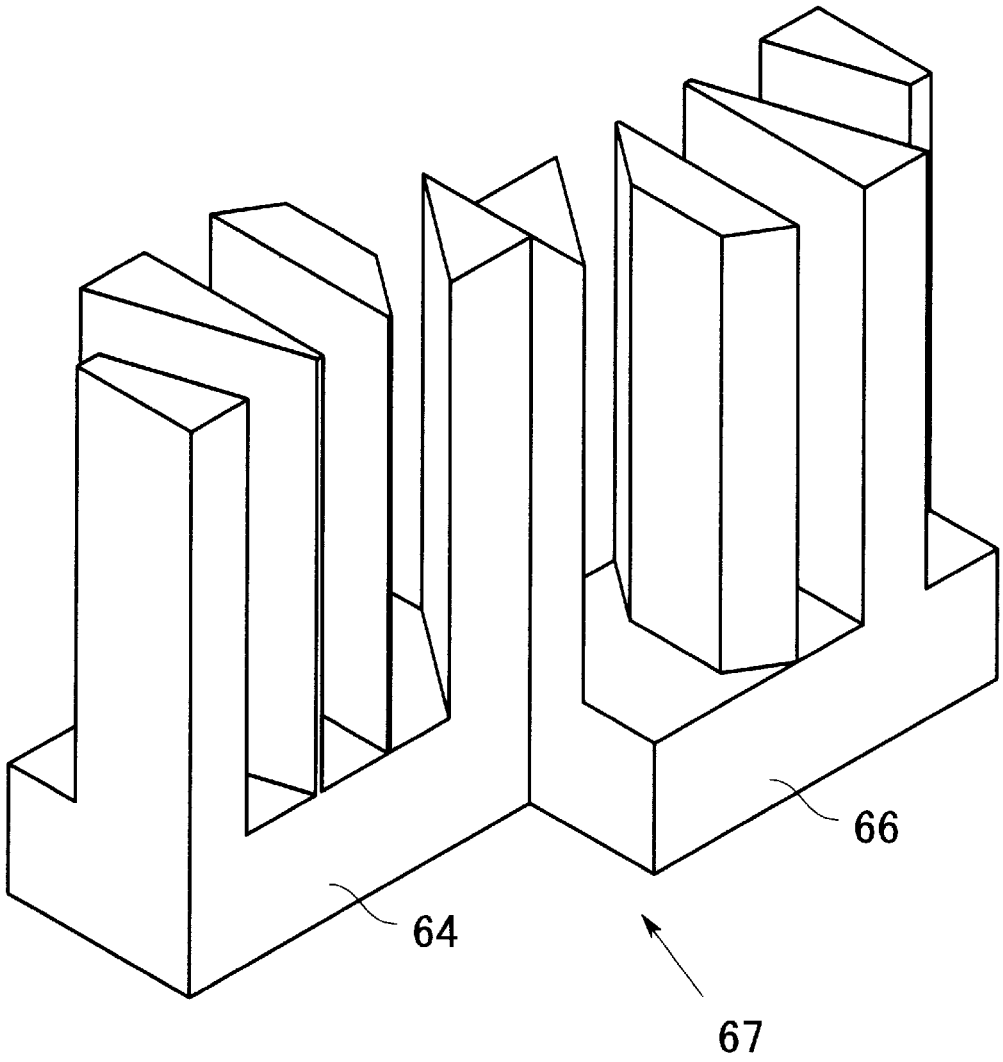
FIG. 13 is a perspective view of the channel-cut monochromator shown in FIG. 12.

Next, the second embodiment of the invention will be explained by referring to FIG. 12 showing a plan view of the second embodiment and FIG. 13 showing its perspective illustration. In FIG. 12, A hybrid-type channel-cut monochromator 67 is composed of a channel-cut monochromator 64 made of silicon single crystal and a channel-cut monochromator 66 made of germanium single crystal united (bonded) to each other to form an integral unit. The two channel-cut monochromators 64 and 66 have the same shape and are united so as to be centrosymmetrical around the axis of rotation 40. The hybrid-type channel-cut monochromator 67 is expected to measure silicon or GaAs, which is typical semiconductor crystal, and to obtain rocking curves with the parallel arrangement or the quasi parallel arrangement of the double crystal method. The rocking curve of silicon single crystal (or an epitaxial layer growing thereon) can be measured with the silicon channel-cut monochromator 64 in the parallel arrangement of the double crystal method, while the rocking curve of GaAs single crystal (or an epitaxial layer growing thereon) can be measured with the germanium channel-cut monochromator 66 in the quasi parallel arrangement of the double crystal method.

There will be explained first a shape of the silicon channel-cut monochromator 64. The first reflecting surface pair 68 is composed of two reflecting surfaces 70 and 72 parallel to each other for diffracting X-rays by {400} plane of silicon crystal. The second reflecting surface pair 74 is composed of two reflecting surfaces 76 and 78 parallel to each other for diffracting X-rays by {422} plane of silicon crystal. The third reflecting surface pair 80 is composed of two reflecting surfaces 82 and 84 parallel to each other for diffracting X-rays by {511} plane of silicon crystal. The three kinds of reflecting surface pairs are designed based on an imaginary circle 46. That is, each reflecting surface pair is so designed that an X-ray beam incident on the reflecting surface pair or its extension line is tangent to the imaginary circle 46, this structure being the same as the first embodiment shown in FIG. 1. The germanium channel-cut monochromator 66 also includes the three kinds of reflecting surface pairs. It is noted that the hybrid-type channel-cut monochromator 67 has no direct path.

Figure 14:
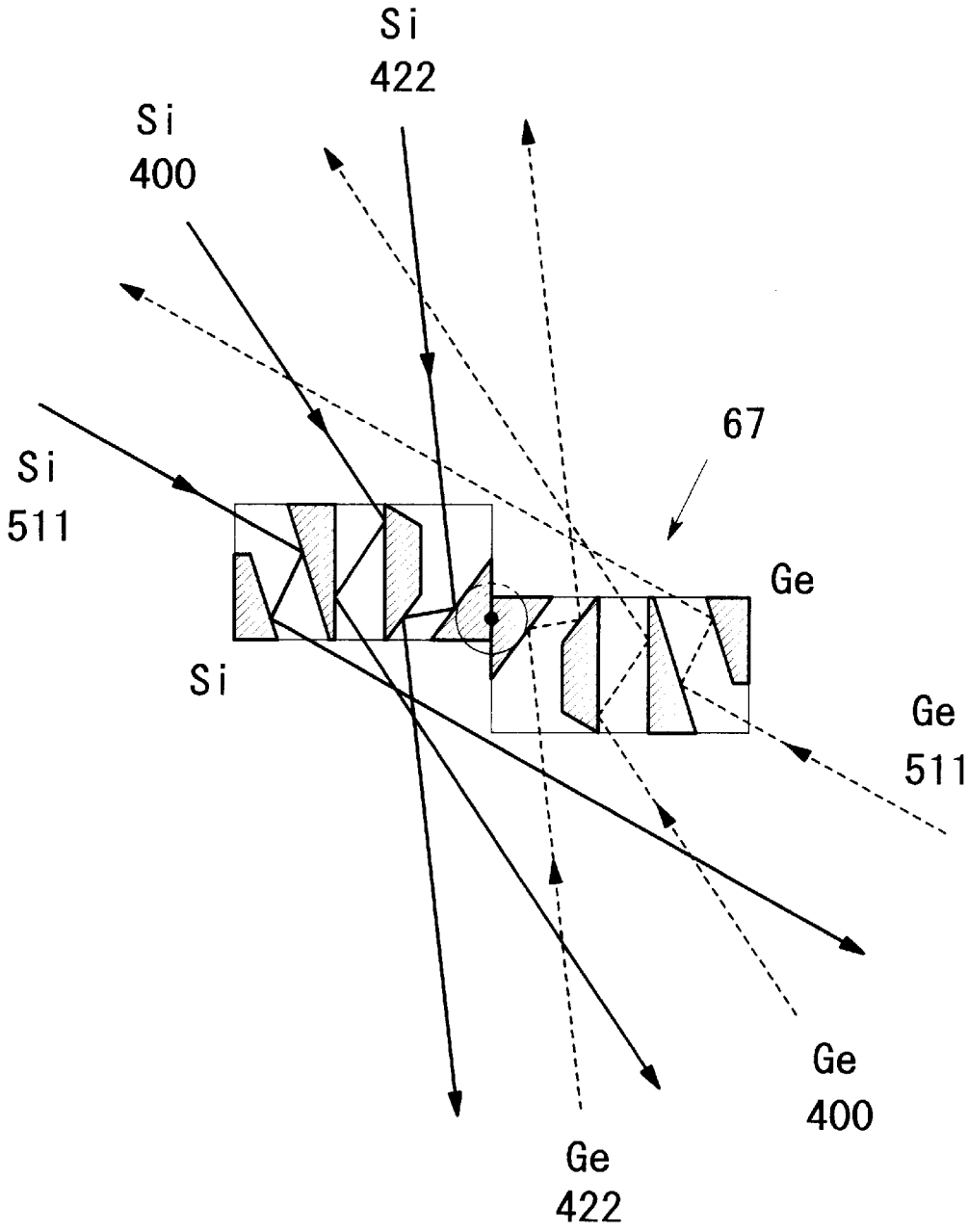
FIG. 14 is a plan view showing a manner in which X-rays coming from in six kinds of directions are reflected by the channel-cut monochromator shown in FIG. 12.

FIG. 14 is a plan view showing a manner in which X-rays coming from in six kinds of directions are reflected by the hybrid-type channel-cut monochromator 67 shown in FIG. 1. The X-ray beam indicated by "Si 400" is to be reflected by {400} plane of silicon crystal. Similarly, the X-ray beams indicated by Si 422 and Si 511 are to be reflected by {422} and {511} planes of silicon crystal. Besides, the X-ray beams indicated by Ge 400, Ge 422 and Ge 511 are to be reflected by {400}, {422} and {511} planes of germanium crystal. It is noted that a direction perpendicular to the drawing sheet coincides with <110> direction of silicon crystal and germanium crystal.

Although FIG. 14 shows various directions of incident X-ray beams with the channel-cut monochromator 67 being stationary, the incident X-ray beams are generally always in the same direction in the actual high-resolution X-ray diffractometer, so that the channel-cut monochromator 67 is rotated to alter the direction of the incident X-ray beam to the monochromator 67. There will be described hereinafter the six states of monochromator rotation for six directions of the incident X-ray beams.

Figure 15:
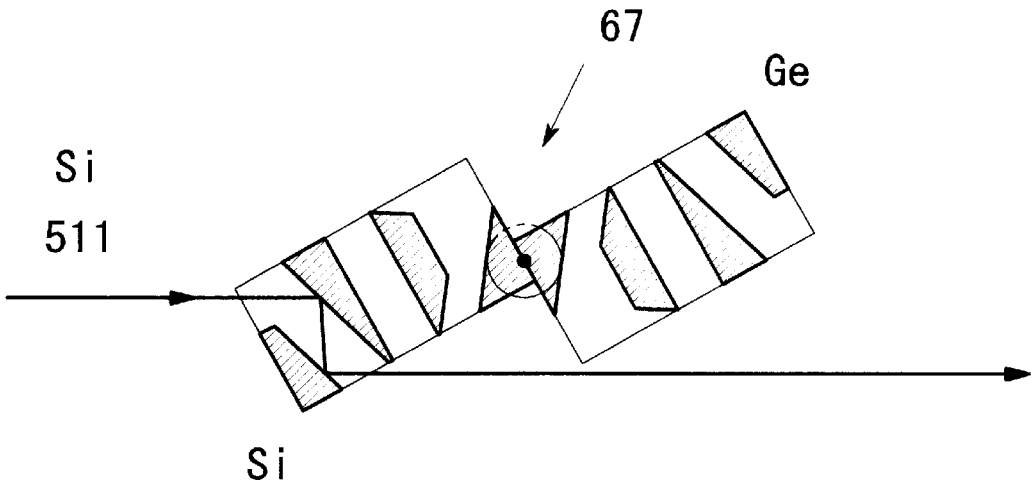
FIG. 15 is a plan view showing a state in which the channel-cut monochromator shown in FIG. 12 is so rotated that an X-ray beam is diffracted by {511} plane of silicon crystal.
Figure 16:
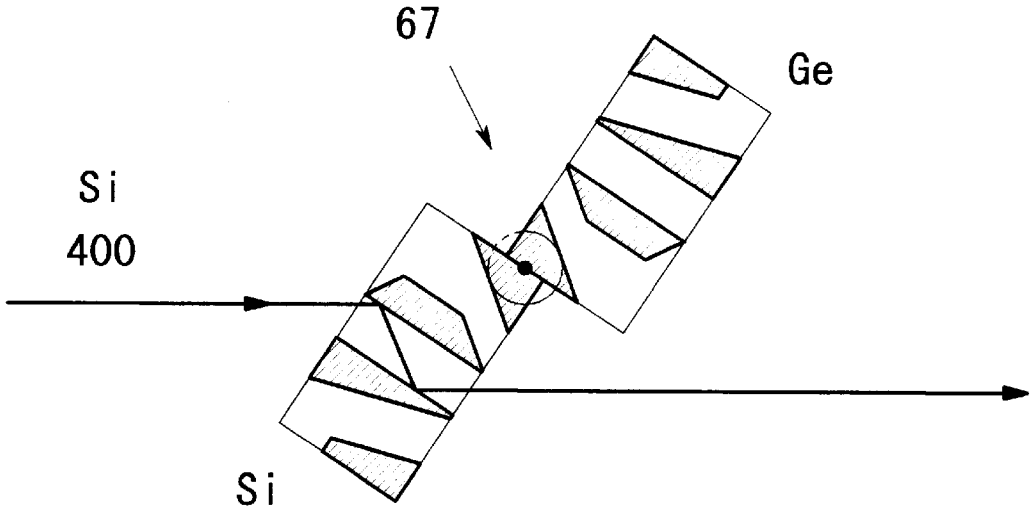
FIG. 16 is a plan view showing a state in which the channel-cut monochromator shown in FIG. 12 is so rotated that an X-ray beam is diffracted by {400} plane of silicon crystal.
Figure 17:
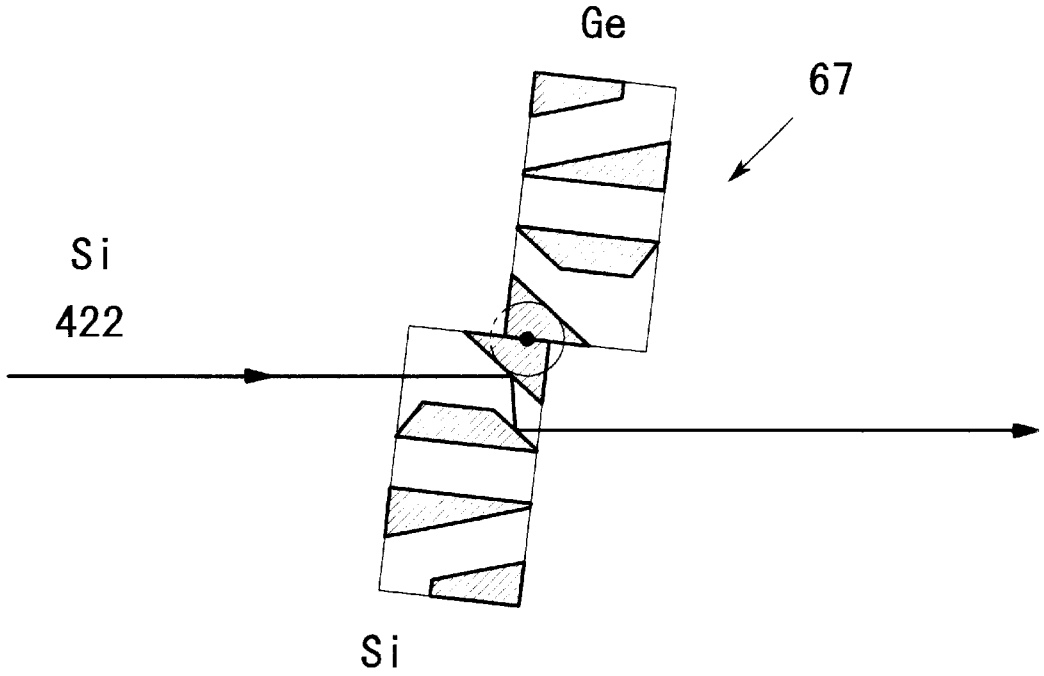
FIG. 17 is a plan view showing a state in which the channel-cut monochromator shown in FIG. 12 is so rotated that an X-ray beam is diffracted by {422} plane of silicon crystal.

FIG. 15 shows a state in which an X-ray beam is diffracted by {511} plane of silicon crystal. FIG. 16 shows a state in which an X-ray beam is diffracted by {400} plane of silicon crystal. FIG. 17 shows a state in which an X-ray beam is diffracted by {422} plane of silicon crystal. In each state, the channel-cut monochromator 67 is so rotated by the predetermined angle around the axis of rotation 40 that each reflecting surface is inclined by the predetermined angle (an incident angle satisfying the Bragg's law) to the incident X-ray beam. Similarly, using germanium crystal, the channel-cut monochromator 67 is rotated to diffract X-rays by Ge {511} Ge {400} and Ge {422} planes.

What is claimed is:

1. A channel-cut monochromator for X-rays manufactured by processing grooves on a single crystal block to have a plurality of reflecting surfaces, wherein:

(a) said channel-cut monochromator comprises at least two kinds of reflecting surface pairs, which have different reflection Miller indices, processed on a common single crystal block, each of said reflecting surface pairs being composed of a first reflecting surface and a second reflecting surface between which X-rays are reflected an even-number times;

(b) any one of said reflecting surface pairs has said first reflecting surface and said second reflecting surface both of which are perpendicular to a common reference plane;

(c) said channel-cut monochromator is rotatable around an axis of rotation perpendicular to said reference plane; and (d) an X-ray beam incident on any one of said reflecting surface pairs or an extension line thereof is tangent to a common imaginary circle whose center coincides with said axis of rotation.

2. A channel-cut monochromator according to claim 1, further comprising a direct path through which an X-ray beam passes without contact with any reflecting surface, and which is tangent to said imaginary circle.

3. A channel-cut monochromator according to claim 1, wherein at least one of said reflecting surface pairs comprises at least one asymmetrical reflecting surface.

4. A channel-cut monochromator for X-rays manufactured by processing grooves on a single crystal block to have a plurality of reflecting surfaces, wherein:

(a) said channel-cut monochromator comprises at least two kinds of reflecting surface pairs processed on a common single crystal block, each of said reflecting surface pairs being composed of a first reflecting surface and a second reflecting surface between which X-rays are reflected an even-number times;

(b) any one of said reflecting surface pairs has said first reflecting surface and said second reflecting surface both of which are perpendicular to a common reference plane;

(c) said channel-cut monochromator is rotatable around an axis of rotation perpendicular to said reference plane; and (d) an X-ray beam incident on any one of said reflecting surface pairs or an extension line thereof is tangent to a common imaginary circle whose center coincides with said axis of rotation; and wherein at least one of said reflecting surface pairs comprises at least one asymmetrical reflecting surface, and said asymmetrical reflecting surface is capable of condensing an X-ray beam width.

5. A channel-cut monochromator for X-rays manufactured by processing grooves on a single crystal block to have a plurality of reflecting surfaces, wherein:

(a) said channel-cut monochromator comprises at least two kinds of reflecting surface pairs processed on a common single crystal block, each of said reflecting surface pairs being composed of a first reflecting surface and a second reflecting surface between which X-rays are reflected an even-number times;

(b) any one of said reflecting surface pairs has said first reflecting surface and said second reflecting surface both of which are perpendicular to a common reference plane;

(c) said channel-cut monochromator is rotatable around an axis of rotation perpendicular to said reference plane; and (d) an X-ray beam incident on any one of said reflecting surface pairs or an extension line thereof is tangent to a common imaginary circle whose center coincides with said axis of rotation; and wherein said channel-cut monochromator comprises at least five kinds of reflecting surface pairs.

6. A channel-cut monochromator according to claim 5, wherein said block is made of silicon or germanium single crystal and comprises at least five kinds of reflecting surface pairs for reflection.

7. A channel-cut monochromator according to claim 6, further comprising a direct path through which an X-ray beam passes without contact with any reflecting surface, and which is tangent to said imaginary circle.

8. A channel-cut monochromator according to claim 6, wherein at least one of said reflecting surface pairs comprises at least one asymmetrical reflecting surface.

9. A channel-cut monochromator according to claim 8, wherein said asymmetrical reflecting surface is capable of condensing an X-ray beam width.

10. A channel-cut monochromator according to claim 8, wherein one of said reflecting surface pairs for reflection comprises at least one asymmetrical reflecting surfaces.

11. A channel-cut monochromator according to claim 10, wherein said reflecting surface pair for reflection comprises one asymmetrical reflecting surface and one symmetrical reflecting surface.

12. A channel-cut monochromator according to claim 10, wherein said reflecting surface pair for reflection comprises two asymmetrical reflecting surfaces.

13. A channel-cut monochromator for X-rays manufactured by processing grooves on a single crystal block to have a plurality of reflecting surfaces, wherein:

(a) said channel-cut monochromator comprises at least two kinds of reflecting surface pairs processed on a common single crystal block, each of said reflecting surface pairs being composed of a first reflecting surface and a second reflecting surface between which X-rays are reflected an even-number times;

(b) any one of said reflecting surface pairs has said first reflecting surface and said second reflecting surface both of which are perpendicular to a common reference plane;

(c) said channel-cut monochromator is rotatable around an axis of rotation perpendicular to said reference plane; and (d) an X-ray beam incident on any one of said reflecting surface pairs or an extension line thereof is tangent to a common imaginary circle whose center coincides with said axis of rotation; and wherein a silicon single crystal block having at least two kinds of reflecting surface pairs and a germanium single crystal block having at least two kinds of reflecting surface pairs are fixed to each other, and each block has in common said axis of rotation and said imaginary circle.

14. A channel-cut monochromator according to claim 13, wherein said silicon single crystal block and said germanium single crystal block each comprise at least three kinds of reflecting surface pairs for reflection.

* * * * *